US008302785B2

(12) United States Patent
Kao

(10) Patent No.: US 8,302,785 B2
(45) Date of Patent: Nov. 6, 2012

(54) TOOL HANGER ASSEMBLY

(76) Inventor: Jui-Chien Kao, Tali (TW)

( * ) Notice: Subject to any disclaimer, the term of this patent is extended or adjusted under 35 U.S.C. 154(b) by 193 days.

(21) Appl. No.: 12/940,358

(22) Filed: Nov. 5, 2010

(65) Prior Publication Data

US 2012/0111814 A1 May 10, 2012

(51) Int. Cl.
*A47F 7/00* (2006.01)

(52) U.S. Cl. ..... 211/70.6

(58) Field of Classification Search ..... 211/70.6, 211/94.01, 69, 66, 70.8, 89.01, DIG. 1, 87.01, 211/175; 206/349, 372, 373, 375, 376, 378, 206/493; 248/111, 113, 223.41, 231.85, 248/316.4

See application file for complete search history.

(56) References Cited

U.S. PATENT DOCUMENTS 3,980,384 A * 9/1976 Lawson ..... 439/710
5,544,747 A * 8/1996 Horn ..... 206/378
5,711,435 A * 1/1998 Morison et al. ..... 211/90.01
6,070,745 A * 6/2000 Dembicks ..... 211/70.6
6,431,373 B1 * 8/2002 Blick ..... 211/70.6
6,488,151 B2 * 12/2002 Ramsey et al. ..... 206/378
6,571,966 B1 * 6/2003 Hsiao ..... 211/70.6
6,626,402 B1 * 9/2003 Kaminstein ..... 248/110
7,028,854 B1 * 4/2006 Londrico ..... 211/89.01
7,717,278 B2 * 5/2010 Kao ..... 211/70.6
7,861,871 B2 * 1/2011 Kao ..... 211/70.6
8,152,003 B1 * 4/2012 Kao ..... 211/70.6
2004/0238466 A1 * 12/2004 Shiao ..... 211/70.6
2006/0207951 A1 * 9/2006 Wang ..... 211/70.6
2009/0218302 A1 * 9/2009 Winnard ..... 211/70.6
2010/0320162 A1 * 12/2010 Kao ..... 211/70.6
2011/0192810 A1 * 8/2011 Kao ..... 211/70.6
2012/0138553 A1 * 6/2012 Kao ..... 211/70.6

* cited by examiner

*Primary Examiner* — Jennifer E. Novosad
(74) *Attorney, Agent, or Firm* — patenttm.us

(57) ABSTRACT

A tool hanger assembly has a frame and a hanger. The frame has a back plate and a bracket. The bracket is mounted securely on the back plate and has a recess formed in the bracket. The hanger is connected securely with the frame and has a base plate, multiple screwing devices and multiple arms. The base plate is mounted securely in the recess. The screwing devices are mounted through the base plate and mounted in the bracket to connect securely the base plate with the bracket. The arms are securely mounted on the base plate to allow wrenches to be hung on. Accordingly, to assemble the hanger having the multiple arms with the frame is quick, reduces manufacturing cost and is convenient.

4 Claims, 8 Drawing Sheets

TOOL HANGER ASSEMBLY

BACKGROUND OF THE INVENTION

1. Field of the Invention

The present invention relates to a tool hanger assembly, and more particularly to a tool hanger assembly to save time for assembling.

2. Description of Related Art

A conventional tool hanger assembly has a frame and multiple hangers. The frame has a track formed in a side surface of the frame. The hangers are slidably mounted on the track and each hanger has an arm protruding from the hanger to hang a wrench.

However, to assemble the multiple hangers onto the frame is time-consuming, increases manufacturing cost and is not convenient.

To overcome the shortcomings, the present invention intends to provide a tool hanger assembly to obviate the aforementioned problems.

SUMMARY OF THE INVENTION

The main objective of the invention is to provide a tool hanger assembly to save time for assembling.

A tool hanger assembly has a frame and a hanger. The frame has a back plate and a bracket. The bracket is mounted securely on the back plate and has a recess formed in the bracket. The hanger is connected securely with the frame and has a base plate, multiple screwing devices and multiple arms. The base plate is mounted securely in the recess. The screwing devices are mounted through the base plate and mounted in the bracket to connect securely the base plate with the bracket. The arms are securely mounted on the base plate to allow wrenches to be hung on. Accordingly, to assemble the hanger having the multiple arms with the frame is quick, reduces manufacturing cost and is convenient.

Other objectives, advantages and novel features of the invention will become more apparent from the following detailed description when taken in conjunction with the accompanying drawings.

DETAILED DESCRIPTION OF PREFERRED EMBODIMENT

Figure 1:
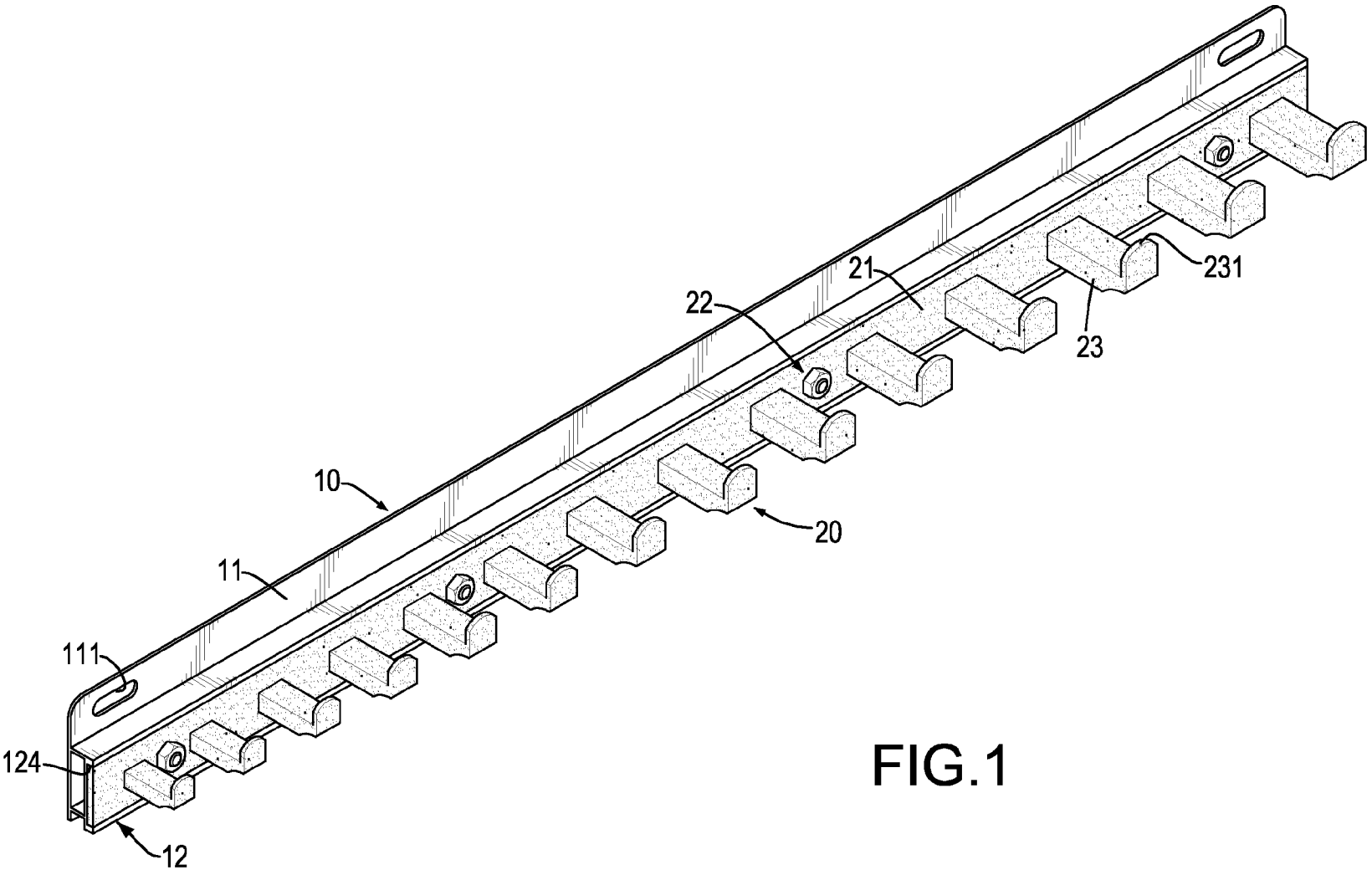
FIG. 1 is a perspective view of a first embodiment of a tool hanger assembly in accordance with the present invention.
Figure 3:
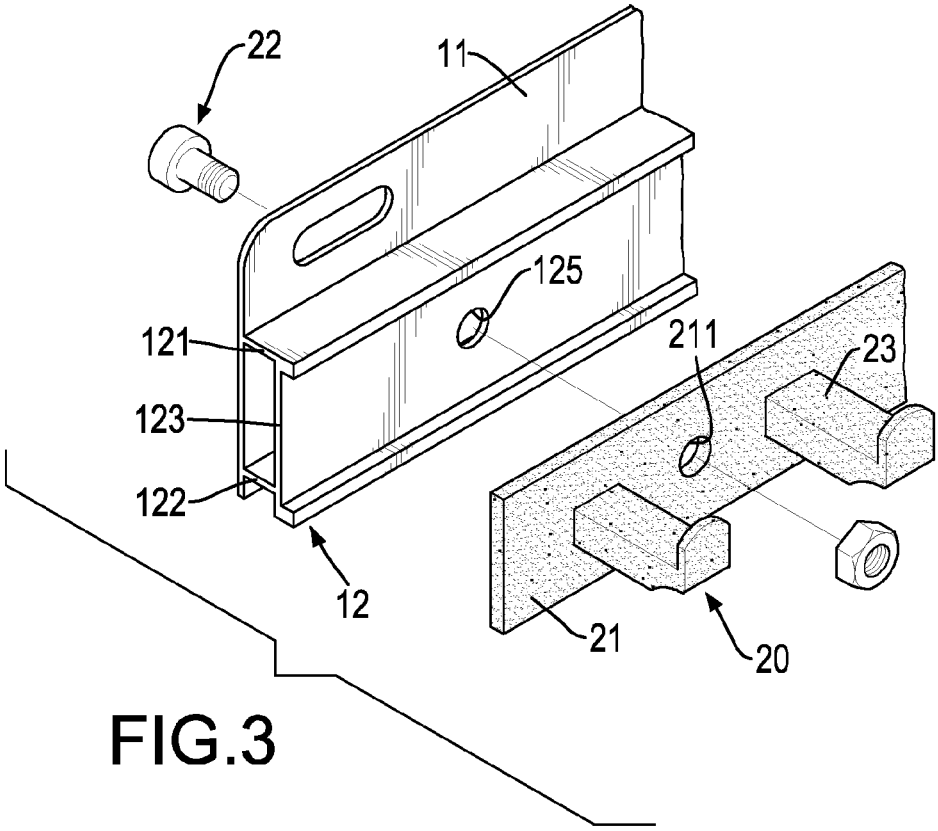
FIG. 3 is an enlarged exploded perspective view of the tool hanger assembly in FIG. 1.
Figure 5:
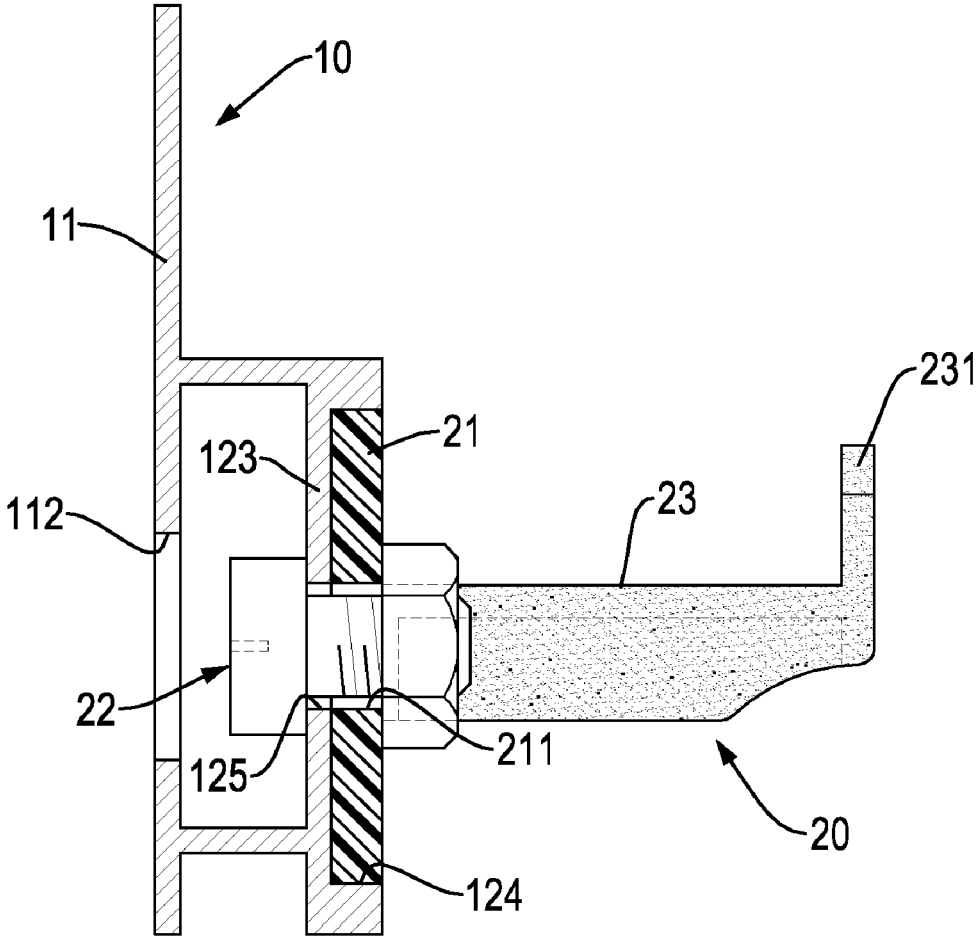
FIG. 5 is an enlarged side view in partial section of the tool hanger assembly in FIG. 1.

With reference to FIGS. 1, 3 and 5, a first embodiment of a tool hanger assembly in accordance with the present invention comprises a frame 10 and a hanger 20.

The frame 10 is made of aluminum and has a back plate 11 and a bracket 12. The back plate 11 is elongated and has a top, a bottom, two opposite ends, a side surface, two mounting holes 111 and multiple back holes 112. The bottom is opposite to the top of the back plate 11. The mounting holes 111 are formed through near the top and respectively near the opposite ends of the back plate 11 to allow the frame 10 to be hung on a wall or a display board. The back holes 112 are formed through the back plate 11 at intervals.

The bracket 12 is mounted securely on the side surface of the frame 10, is elongated and has a length, an upper protrusion 121, a lower protrusion 122, a front plate 123, a recess 124 and multiple front holes 125. The length of the bracket 12 is the same as that of the side surface of the back plate 11. The upper protrusion 121 is elongated, is mounted securely on the side surface near the top of the back plate 11 and is located below the mounting holes 111. The lower protrusion 122 is elongated, is mounted securely on the side surface near the bottom of the back plate 11 and is located below and parallel to the upper protrusion 121.

The front plate 123 is rectangular, is located between and securely mounted on the upper protrusion 121 and the lower protrusion 122 and has an abutting surface opposite to the back plate 11. The recess 124 is formed between the upper protrusion 121, the lower protrusion 122 and the front plate 123 and has a bottom located on the abutting surface of the front plate 123. The front holes 125 are formed through the front plate 123 and respectively align with the back holes 112.

Figure 2:
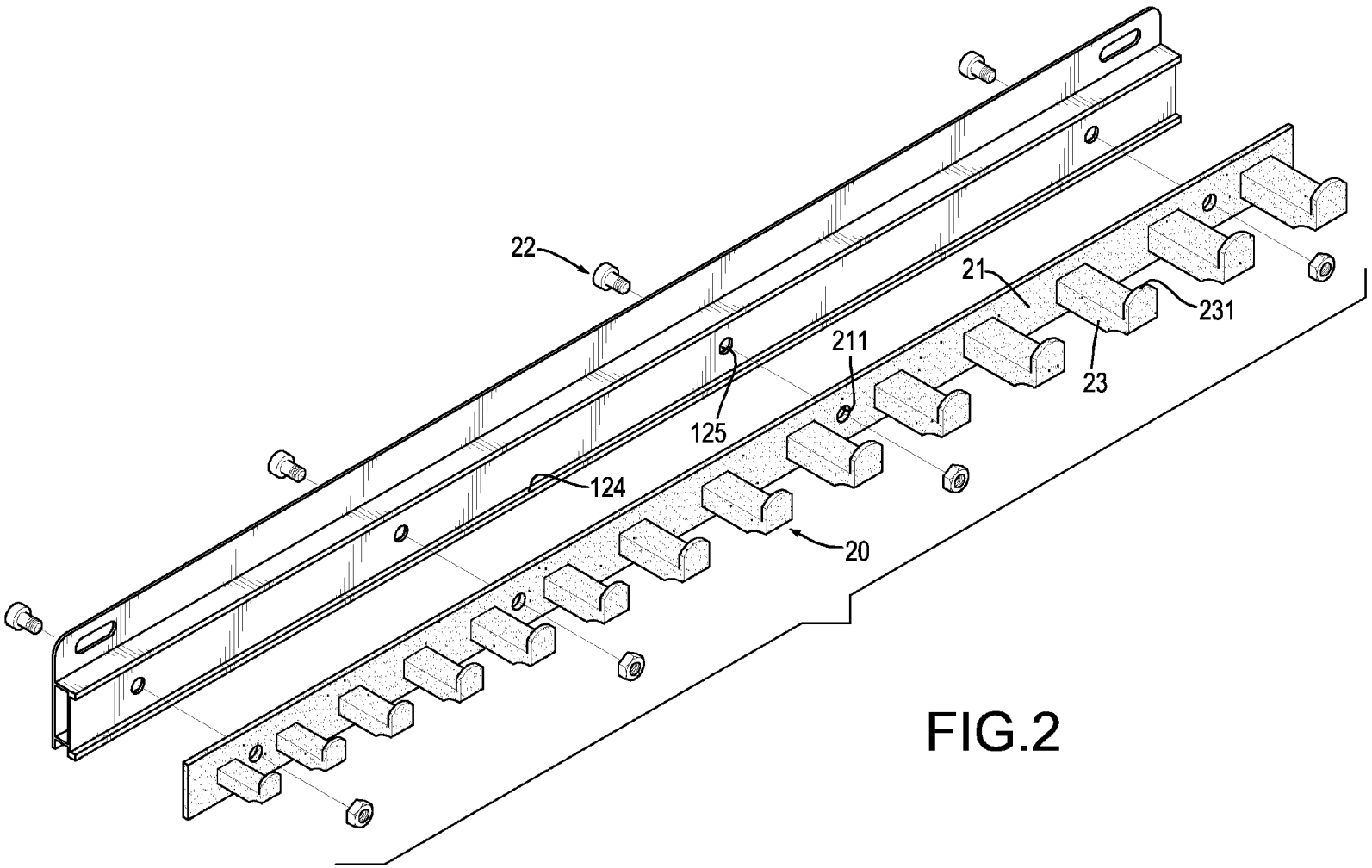
FIG. 2 is an exploded perspective view of the tool hanger assembly in FIG. 1.
Figure 4:
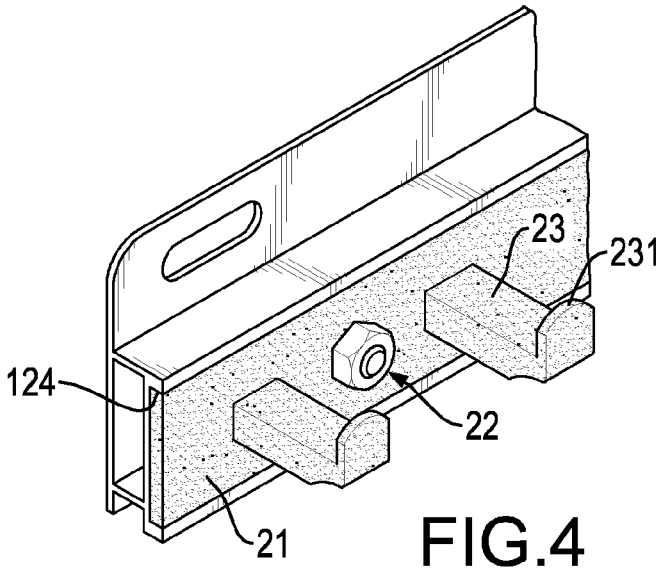
FIG. 4 is an enlarged perspective view of the tool hanger assembly in FIG. 1.

With reference to FIGS. 2, 4 and 5, the hanger 20 is connected securely with the frame 10 and has a base plate 21, multiple screwing devices 22 and multiple arms 23. The base plate 21 is made of plastic, is shaped as and mounted securely in the recess 124 and has a mounting surface and multiple apertures 211. The mounting surface of the base plate 21 is opposite to the abutting surface of the front plate 123. The apertures 211 are formed through the base plate 21 and respectively align with the front holes 125. The screwing devices 22 are mounted respectively in the apertures 211. Each screwing device 22 has a bolt and a nut screwed with the bolt. Each screwing device 22 is mounted through one of the apertures 211 and a corresponding one of the front holes 125 to connect securely the hanger 20 with the frame 10. The arms 23 are mounted securely on the mounting surface of the base plate 21 at intervals. Preferably, the arms 23 protrude integrally from the mounting surface of the base plate 21. Each arm 23 has a distal end and a block 231. The distal end is opposite to the base plate 21. The block 231 is formed on and protrudes upwardly from the distal end of the arm 23.

The frame 10 and the hanger 20 may be made of any possible hard material and the present invention does not limit the material of the frame 10 and the hanger 20.

Figure 6:
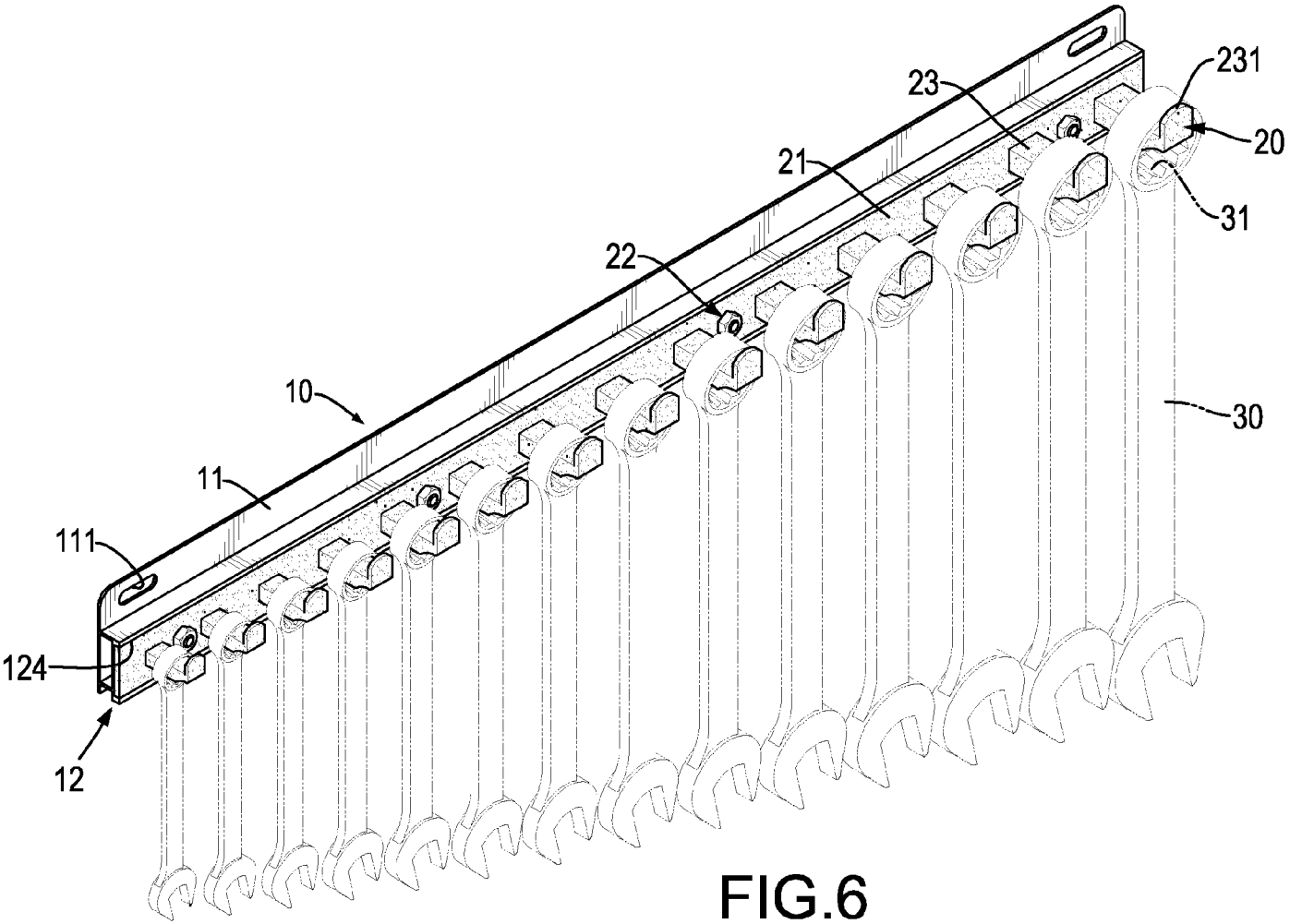
FIG. 6 is an operational perspective view of the tool hanger assembly in FIG. 1, wherein multiple wrenches are respectively hung on the arms.

With reference to FIGS. 1, 5 and 6, each wrench 30 has an operating hole 31 formed through the wrench 30, is hung on one of the arms 23 and is kept from falling off by the blocks 231. The frame 10 made of aluminum has an excellent structural strength to support the hanger 20 and the wrenches 30.

Figure 7:
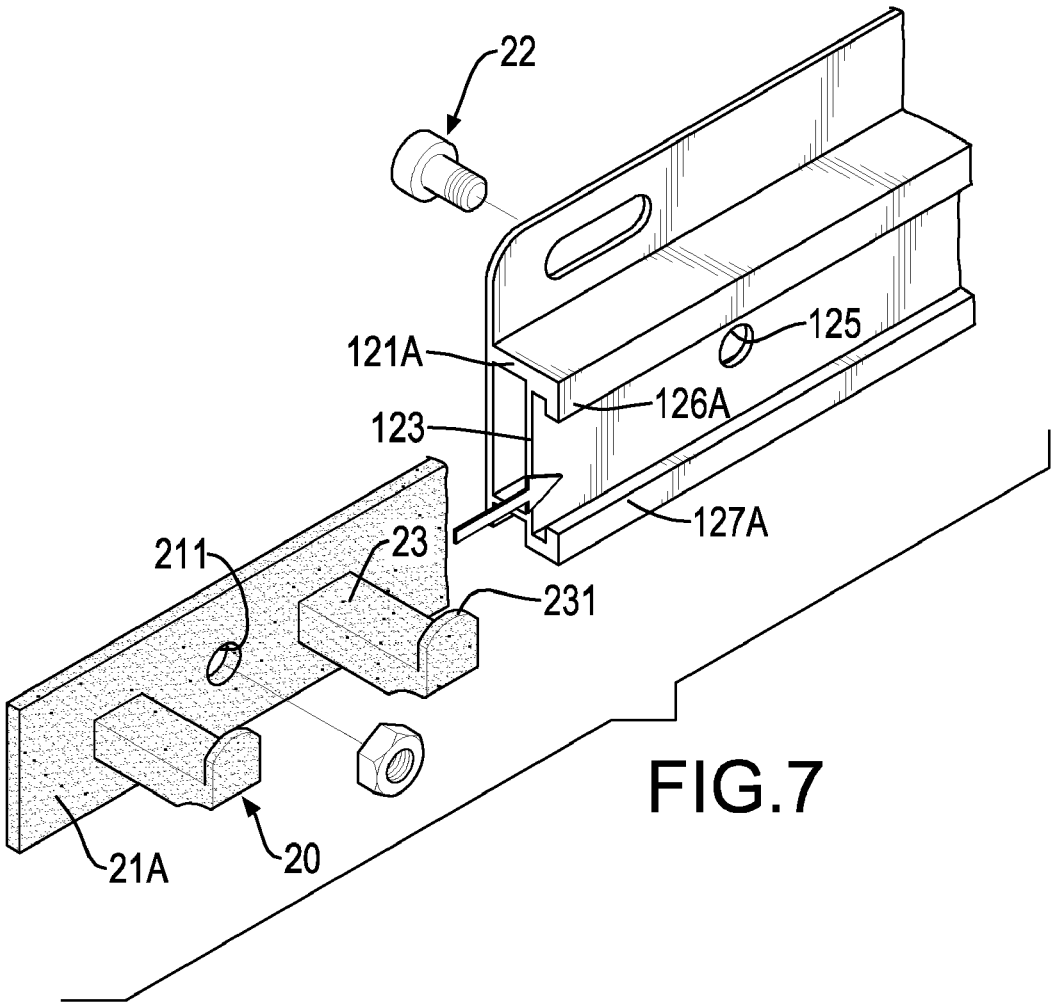
FIG. 7 is an enlarged exploded perspective view of a second embodiment of a tool hanger assembly in accordance with the present invention.
Figure 8:
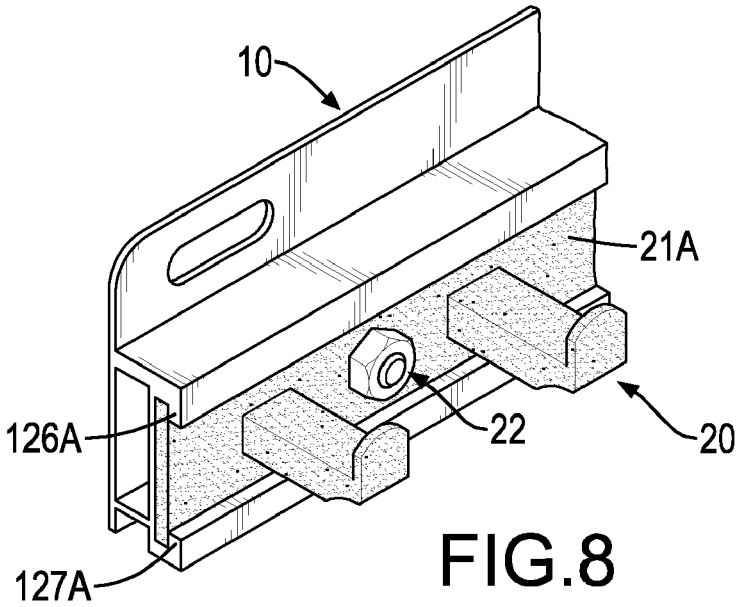
FIG. 8 is a perspective view of the tool hanger assembly in FIG. 7.
Figure 9:
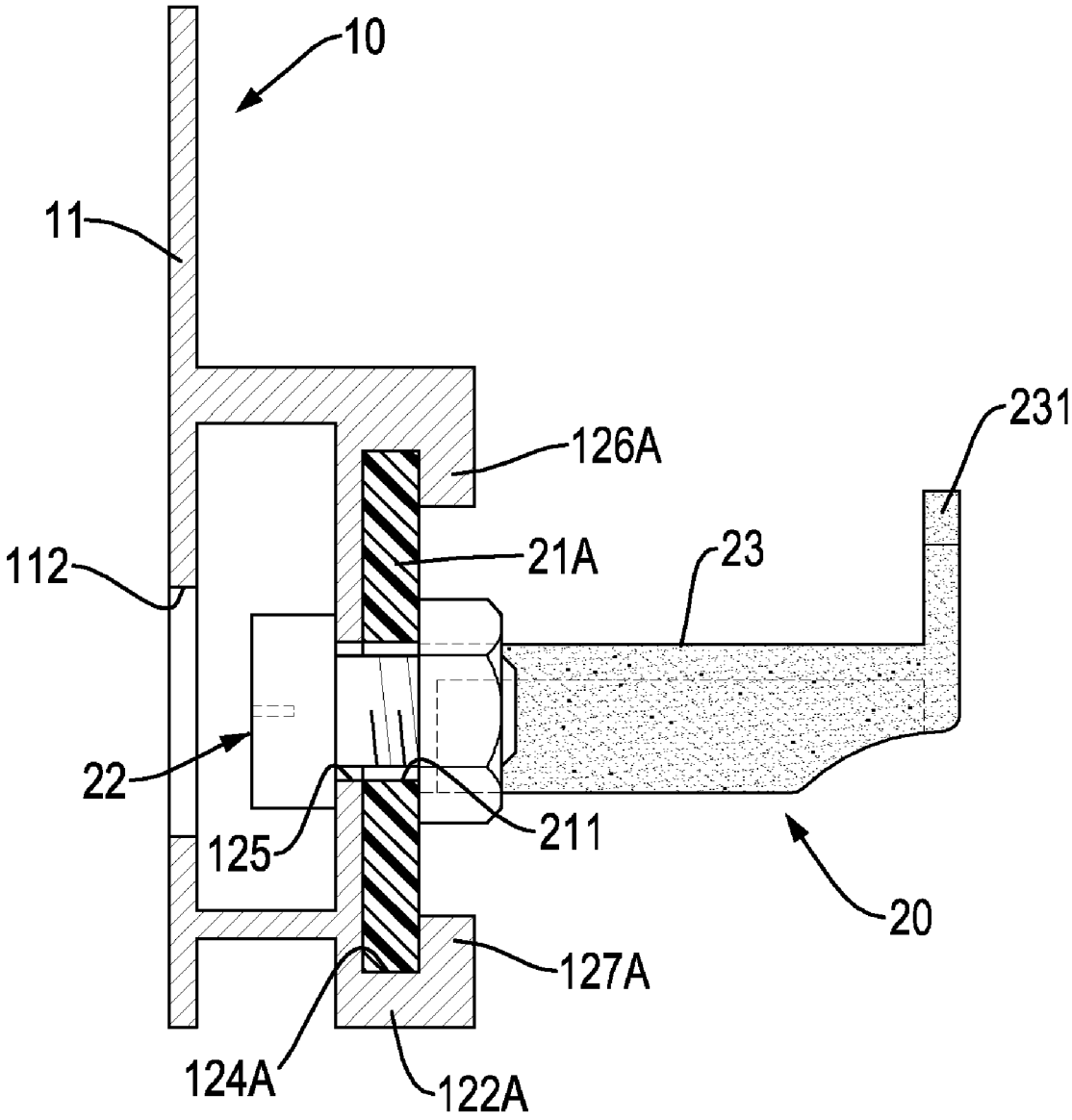
FIG. 9 is a side view in partial section of the tool hanger assembly in FIG. 8.

With reference to FIGS. 7 to 9, a second embodiment of the tool hanger assembly in accordance with the present invention is substantially the same as the first embodiment except that the upper protrusion 121A has an upper rib 126A. The upper rib 126A protrudes from the upper protrusion 121A toward the lower protrusion 122A and abuts the mounting surface of the base plate 21A. The lower protrusion 122A has a lower rib 127A. The lower rib 127A protrudes from the lower protrusion 122A toward the upper protrusion 121A and abuts the mounting surface of the base plate 21A.

Accordingly, the base plate 21A can be slid into the recess 124A and be kept from falling off by the upper rib 126A and the lower rib 127A. The upper rib 126A and lower rib 127A provide a good positioning effect for the base plate 21A.

Figure 10:
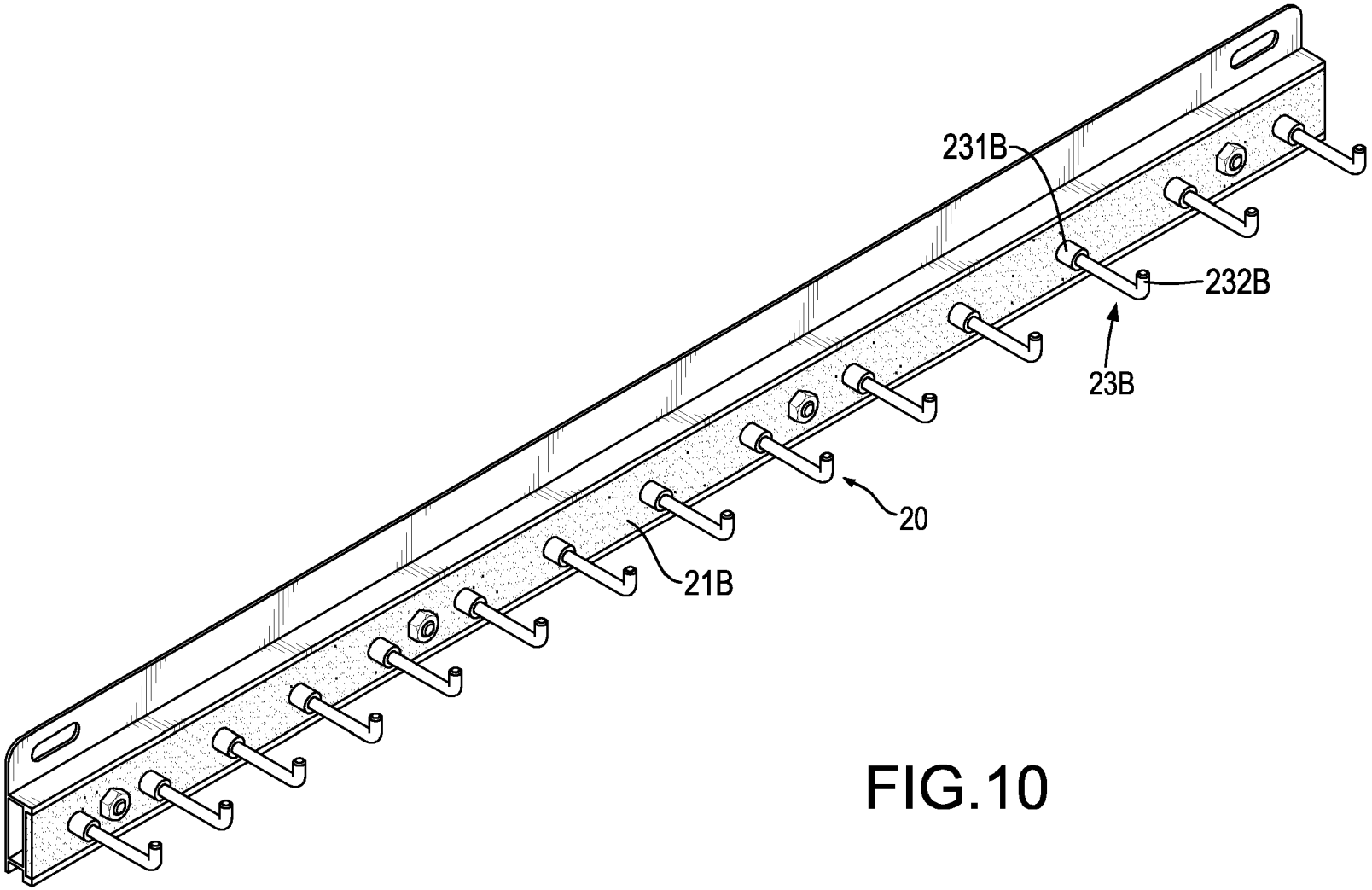
FIG. 10 is a perspective view of a third embodiment of a tool hanger assembly in accordance with the present invention.

With reference to FIG. 10, a third embodiment of the tool hanger assembly in accordance with the present invention is substantially the same as the first embodiment except that each arm 23B has a tubular section 231B and a rod section 232B. The tubular section 231B is mounted securely on the mounting surface of the base plate 21B. The rod section 232B is made of metal and is securely inserted into the tubular section 231B of the arm 23B.

The hanger 20 with the multiple arms 23,23B can hang the multiple wrenches 30. Because combining the hanger 20 having the multiple arms 23,23B with the frame 10 is easy, to assemble the hanger 20 with the frame 10 is quick, reduces manufacturing cost and is convenient for hanging multiple wrenches.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool hanger assembly comprising:

a frame having an elongated back plate having a top;

a bottom opposite to the top of the back plate;

two opposite ends;

a side surface;

two mounting holes formed through near the top and respectively near the opposite ends of the back plate; and multiple back holes formed through the back plate at intervals; and an elongated bracket mounted securely on the side surface of the frame and having a length the same as that of the side surface of the back plate;

an elongated upper protrusion mounted securely on the side surface near the top of the back plate and located below the mounting holes;

an elongated lower protrusion mounted securely on the side surface near the bottom of the back plate and located below and parallel to the upper protrusion;

a rectangular front plate located between and securely mounted on the upper protrusion and the lower protrusion and having an abutting surface opposite to the back plate;

a recess formed between the upper protrusion, the lower protrusion and the front plate and having a bottom located on the abutting surface of the front plate; and multiple front holes formed through the front plate and respectively aligning with the back holes; and a hanger connected securely with the frame and having a base plate shaped as and mounted securely in the recess and having a mounting surface opposite to the abutting surface of the front plate; and multiple apertures formed through the base plate and respectively aligning with the front holes;

multiple screwing devices mounted respectively in the apertures, each screwing device mounted through one of the apertures and a corresponding one of the front holes to connect securely the hanger with the frame; and multiple arms mounted securely on the mounting surface of the base plate at intervals, each arm having a distal end opposite to the base plate; and a block formed on and protruding upwardly from the distal end of the arm.

2. The tool hanger assembly as claimed in claim 1, wherein the upper protrusion has an upper rib protruding from the upper protrusion toward the lower protrusion and abutting the mounting surface of the base plate; and the lower protrusion has a lower rib protruding from the lower protrusion toward the upper protrusion and abutting the mounting surface of the base plate.

3. The tool hanger assembly as claimed in claim 2, wherein each arm has a tubular section mounted securely on the mounting surface of the base plate; and a rod section securely inserted into the tubular section of the arm.

4. The tool hanger assembly as claimed in claim 1, wherein each arm has a tubular section mounted securely on the mounting surface of the base plate; and a rod section securely inserted into the tubular section of the arm.

* * * * *